US006522081B1

(12) United States Patent
Oversluizen et al.

(10) Patent No.: US 6,522,081 B1
(45) Date of Patent: Feb. 18, 2003

(54) PLASMA DISPLAY PANEL

(75) Inventors: Gerrit Oversluizen, Eindhoven (NL); Siebe T. De Zwart, Eindhoven (NL); Sybrandus Van Heusden, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/631,357

(22) Filed: Aug. 2, 2000

(30) Foreign Application Priority Data

Aug. 4, 1999 (EP) ..... 99202568

(51) Int. Cl.[7] ..... G09G 3/10

(52) U.S. Cl. ..... 315/169.4; 315/169.1; 313/585

(58) Field of Search ..... 315/169.1, 169.3, 315/169.4; 313/582, 584, 585, 489, 587

(56) References Cited

U.S. PATENT DOCUMENTS 5,587,624 A * 12/1996 Komaki ..... 313/584
6,137,227 A * 10/2000 Kim et al. ..... 313/582
6,160,345 A * 12/2000 Tanaka et al. ..... 313/489
6,232,716 B1 * 5/2001 Ok et al. ..... 313/582
6,333,600 B1 * 12/2001 Mizobata ..... 313/587

FOREIGN PATENT DOCUMENTS

| | | | | |
|---|---|---|---|---|
| EP | 0779643 | A2 | 6/1997 | H01J/17/20 |
| EP | 0762463 | A3 | 12/1997 | H01J/17/49 |
| EP | 0762463 | A2 | 12/1997 | H01J/17/49 |
| EP | 0945886 | A1 | 9/1999 | H01J/11/02 |
| JP | 9213215 | A | 8/1997 | H01J/9/02 |
| JP | 11329256 | A | 11/1999 | H01J/11/02 |
| WO | 9827571 | A1 | 6/1998 | H01J/11/02 |

* cited by examiner

*Primary Examiner*—Don Wong
*Assistant Examiner*—Jimmy T. Vu
(74) *Attorney, Agent, or Firm*—Aaron Waxler

(57) ABSTRACT

Plasma display panel in which the fluorescent layer, a dielectric layer having a high relative dielectric constant, is provided between the electrodes and the phosphor(s). This improve the efficacy of the device and lowers minimum sustain voltage and firing voltages.

5 Claims, 2 Drawing Sheets

PLASMA DISPLAY PANEL

BACKGROUND OF THE INVENTION

The invention relates to a plasma display panel comprising discharge spaces with a gas discharge mixture between a first substrate provided with display electrodes and a second substrate provided with projecting parts which define the discharge spaces, and provided with addressing electrodes and a fluorescent material.

Dependent on the type of display device, the fluorescent material is patterned or not patterned.

A display device of this type is used, inter alia, in large flat-panel display screens, for example, for HDTV.

A plasma display panel (PDP) of the type mentioned above is described in EP-A-0 779 643. This document describes measures for enhancing the luminance of such a panel. To this end, inter alia, a favorable composition of the gas discharge mixture (between 10% and less than 100% xenon) is proposed. A higher percentage of xenon is assumed to increase the quantity of UV radiation so that the number of photons incident on the fluorescent material for converting UV radiation to visible light in the fluorescent material is increased. However, it has been found that, at higher xenon percentages, the drive voltages, notably the minimal sustain and firing voltages are increased considerably.

SUMMARY OF THE INVENTION

It is an object of the present invention to obviate said increase of the drive voltages as much as possible.

To this end, a plasma display panel according to the invention is characterized in that a dielectric layer is present on the second substrate between the second substrate and the fluorescent material. For the dielectric layer, it preferably holds that the material of the dielectric layer has a dielectric constant of at least 7. The layer may be composed of a plurality of sub-layers. The relative dielectric constant is understood to be the value applying as a relative dielectric constant for computing the capacitance of a flat capacitor, of which said layer forms the dielectric.

It has been found that this leads to a decrease of said voltages, notably at higher percentages of xenon or another suitable gas (higher gas pressures). A possible explanation is the influence of the dielectric layer on the electric field, where also the curvature of the channel possibly plays a role when it is provided, for example, in a glass substrate by means of powder spraying.

The dielectric layer preferably comprises a material of the group of aluminum oxide ($\in_r$=8), titanium oxide ($\in_r$= 14–100), tantalum oxide ($\in_r$=20–42), thallium oxide, barium titanate, calcium titanate, strontium titanate, magnesium titanate, lead titanate and lead zirconate (for the titanates, $\in_r$ is between 15 and 12,000). These materials have a high relative dielectric constant and can be provided in a simple manner, for example, by means of silk screening in relatively thick layers (5–30 $\mu$m).

A preferred embodiment of a plasma display panel according to the invention is characterized in that the dielectric layer completely covers the walls of the discharge spaces. A maximum voltage decrease is thereby obtained.

A further preferred embodiment of a plasma display panel according to the invention is characterized in that the dielectric layer completely covers the addressing electrode, at least within a display element. This prevents the occurrence of unwanted spark discharges across the surface of the layer.

These and other aspects of the invention are apparent from and will be elucidated with reference to the embodiments described hereinafter.

BRIEF DESCRIPTION OF THE DRAWINGS

In the drawings:

FIG. 2 shows diagrammatically a part of a plasma display panel, while

The Figures are diagrammatic and not to scale. Corresponding parts are generally denoted by the same reference numerals.

DESCRIPTION OF THE PREFERRED EMBODIMENTS

Figure 1:
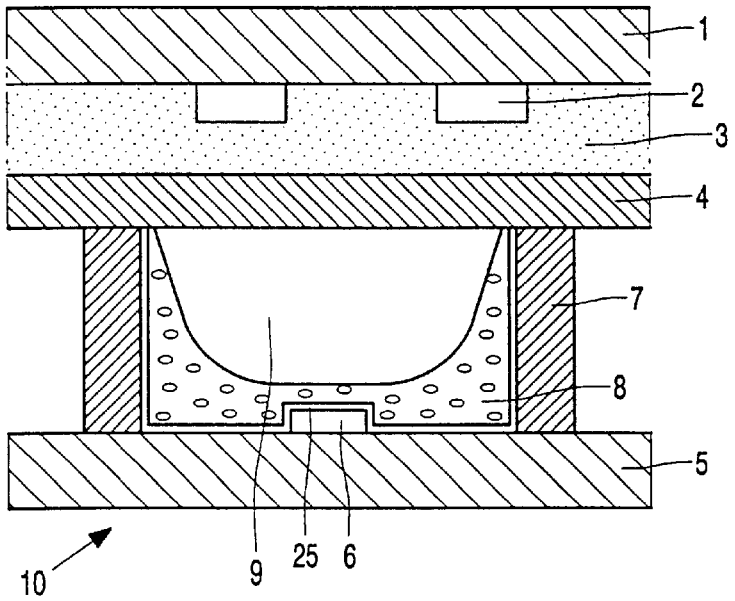
FIG. 1 is a diagrammatic cross-section of a part of a plasma display panel according to the invention.

FIG. 1 shows a plasma display panel 10, in this case an AC display panel (AC PDP or AC Plasma Display Panel), having a first substrate 1 provided with two display electrodes 2 which are coated with a dielectric layer 3 (for example, glass) and a second, transparent substrate 5 provided with a fluorescent material 8. In this example, the second substrate 5 is provided with addressing electrodes 6. FIG. 1 shows only a part of an addressing electrode 6; usually, the addressing electrodes are located in a direction transverse to that of the display electrodes 2 (rotated through 90° in this drawing). In the relevant example, a pixel as defined by the addressing electrode 6 and the display electrodes 2 is bounded by partition walls 7 which bound a discharge space. The dielectric layer 25 does not only extend throughout the addressing electrode 6 but also beyond the partition walls 7. If desired, the layer 25 may extend beyond the tops of the partition walls.

A gas discharge mixture 9 consisting, in this example, of a neon-xenon mixture, is present between the substrates 1, 5 in the discharge space. Other mixtures are alternatively possible, such as helium-xenon, argon-xenon, krypton-xenon, argon-neon-xenon, argon-helium-xenon, krypton-neon-xenon, krypton-helium-xenon or mixtures thereof, in which the quantity of xenon is in a range between 5 and less than 100%.

Figure 2:
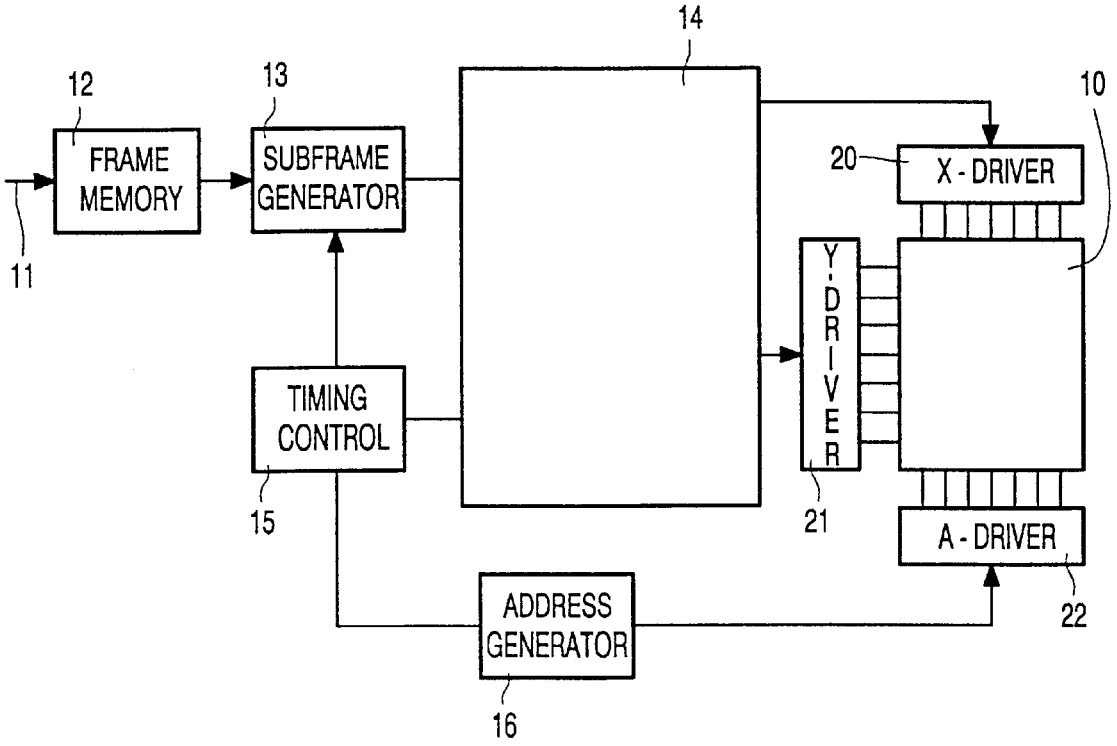

As is known, UV radiation is generated at the area of a pixel in the discharge space of plasma display panels or PDPs, which UV radiation causes the fluorescent material 8 (phosphors) to luminesce. To this end, the display electrodes 2 are driven, for example, by X and Y drivers 20, 21, and the addressing electrodes are driven by an A driver 22 (FIG. 2). To this end, an incoming signal 11 is stored in a frame memory 12 and in a sub-frame generator 13. In the processing unit 14, the required pulses are generated for the reset pulses, the firing pulses and the sustain pulses which energize the display electrodes 2 via the X and Y drivers 20, 21, while addressing takes place via the A driver 22 controlled by an address generator 16. Mutual synchronization takes place via a timing control circuit 15.

After a pixel has been ignited, the ignition is maintained by sustain pulses across the display electrodes within a pixel. Dependent on the grey tint to be displayed, these are presented more frequently or less frequently per pixel.

According to the invention, a dielectric layer 25 which, in this example, completely covers the addressing electrode 6, is present between the addressing electrode 6 and the fluorescent material 8. In this example, the dielectric layer 25 is constituted by a layer of titanium oxide having a thickness of approximately 15 $\mu$m. Titanium oxide has a relative dielectric constant ($\in_r$) of 14–110, dependent on the stoichiometry and the manufacturing method. Other suitable materials having a high relative dielectric constant $\in_r$ are, for example, aluminum oxide, tantalum oxide, thallium oxide, barium titanate, calcium titanate, strontium titanate, magnesium titanate, lead titanate and lead zirconate. The provision of such a layer 25 decreases the drive voltages, notably the minimum sustain voltage and the firing voltage.

Figure 3:
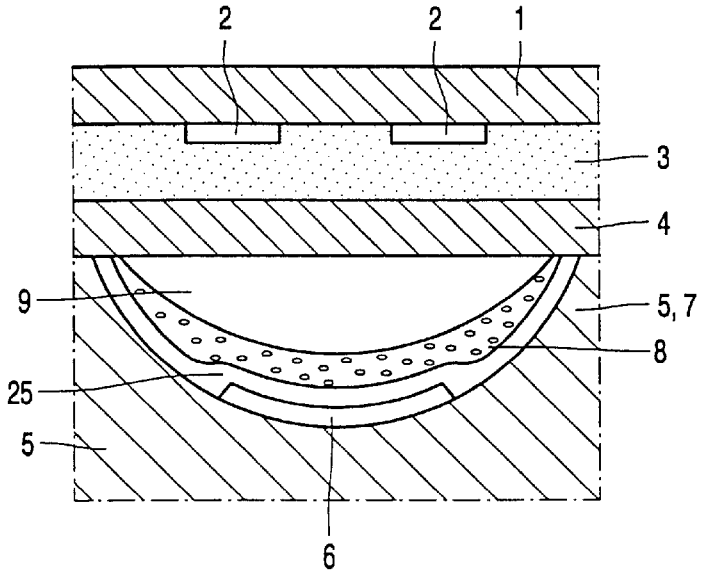
FIG. 3 shows a variant of FIG. 1.

FIG. 3 shows a variant of FIG. 1 in which the partition walls 7 and the discharge space bounded thereby are provided in the substrate 5, for example, by means of sandblasting in glass. The discharge space (the discharge channel) thus has a curved bottom surface (viewed in a cross-section).

The effect of the dielectric layer 25 is illustrated with reference to the Table below. This Table states, for different percentages of xenon in the gas discharge mixture (3.5% and 10%) and for different phosphors ($Zn_2SiO_4$: Mn or willemite in the case of a monochrome panel and three phosphors in the case of a color panel) the minimum sustain voltage $V_{sm}$ and the firing voltage $V_f$ for display devices without and with a layer of titanium oxide having a thickness of approximately 15 $\mu$m. Good results are already obtained at thicknesses from 5 $\mu$m. The maximum thickness of the layer 25 is also defined by the dimensions of the discharge space.

The efficiency $\eta$ measured under these circumstances is measured at a sustain voltage $V_{sm}$ of 400 V (peak to peak).

| | $V_{sm}$(V) | $V_f$(V) | $\eta$(400 V) (lm/Watt) |
|---|---|---|---|
| 3.5% Xe, Willemite, without dielectric layer | 267 | 435 | 1.12 |
| 3.5% Xe, Willemite, with dielectric layer ($TiO_2$) | 260 | 420 | 1.17 |
| 10% Xe, three phosphors, without dielectric layer | 318 | 495 | 1.26 |
| 10% Xe, three phosphors, with dielectric layer ($TiO_2$) | 305 | 468 | 1.61 |

The Table shows that, notably at a higher percentage of xenon in the gas discharge mixture, the provision of the dielectric layer (titanium oxide in this example) does not only decrease the minimum sustain voltage $V_{sm}$ and the firing voltage $V_f$, but also enhances the efficiency.

Figure 4:
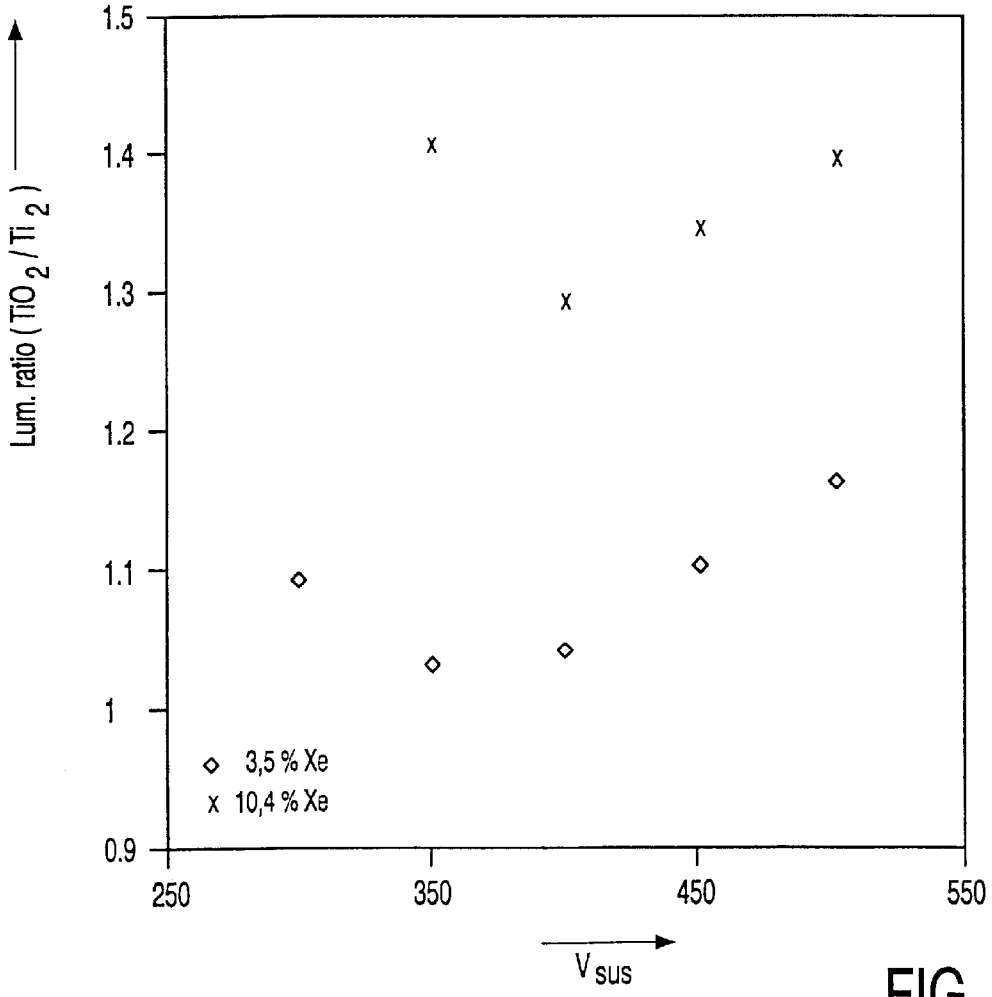
FIG. 4 shows the increase of luminance for a plasma display panel according to the invention, as a function of the sustain voltage for different percentages of xenon in the gas discharge mixture.

FIG. 4 shows how the luminance also increases with the efficiency when the same power is used and when a dielectric layer is added between the addressing electrode 6 and the fluorescent material 8. FIG. 4 shows the ratio of the luminance measured in a display device with and without the layer of titanium oxide for different percentages of xenon in the gas discharge mixture (3.5% and 10%). It appears from the Figure that the luminance increases, notably at a higher percentage of xenon.

The invention is of course not limited to the examples shown, but several variations are possible within the scope of the invention. As already stated, different materials having a high relative dielectric constant may be used.

The invention resides in each and every novel characteristic feature and each and every combination of characteristic features.

What is claimed is:

1. A plasma display panel comprising discharge spaces with a gas discharge mixture between a first substrate provided with display electrodes and a second substrate provided with projecting parts which define the discharge spaces, and provided with addressing electrodes and a fluorescent material, characterized in that a dielectric layer is present on the second substrate between the second substrate and the fluorescent material, wherein the dielectric layer comprises a material of the group of aluminum oxide, titanium oxide, tantalum oxide, thallium oxide, barium titanate, calcium titanate, strontium titanate, magnesium titanate, lead titanate and lead zirconate.

2. A plasma display panel as claimed in claim 1, wherein the material of the dielectric layer has a relative dielectric constant of at least 7.

3. A plasma display panel as claimed in claim 1, wherein the material of the dielectric layer has a relative dielectric constant of at least 15.

4. A plasma display panel as claimed in claim 1, wherein the dielectric layer has a thickness of at least 5 $\mu$m.

5. A plasma display panel as claimed in claim 4, wherein the dielectric layer has a thickness of at least 15 $\mu$m.

* * * * *